US006745517B2

(12) United States Patent
Vahldieck

(10) Patent No.: US 6,745,517 B2
(45) Date of Patent: Jun. 8, 2004

(54) LEAF REPELLANT GUTTER BRACKET

(76) Inventor: Wayne Vahldieck, 357 Ocean Ave., Amityville, NY (US) 11701

( * ) Notice: Subject to any disclaimer, the term of this patent is extended or adjusted under 35 U.S.C. 154(b) by 0 days.

(21) Appl. No.: 10/193,415

(22) Filed: Jul. 11, 2002

(65) Prior Publication Data

US 2003/0041528 A1 Mar. 6, 2003

Related U.S. Application Data

(60) Provisional application No. 60/316,816, filed on Aug. 31, 2001.

(51) Int. Cl.[7] ..... E04D 13/064

(52) U.S. Cl. ..... 52/12; 52/15; 52/11; 248/48.2

(58) Field of Search ..... 52/11, 12, 14, 52/15, 288.1, 312; 248/48.1, 48.2, 65; D8/354, 373, 380–381

(56) References Cited

U.S. PATENT DOCUMENTS

| | | | | |
|---|---|---|---|---|
| D25,785 S | * | 7/1896 | Corscaden | D8/381 |
| D32,585 S | * | 4/1900 | Pessano | D8/363 |
| 891,406 A | | 6/1908 | Cassens | |
| 2,672,832 A | | 3/1954 | Goetz | |
| 3,426,488 A | | 2/1969 | Stanford | |
| 4,169,570 A | | 10/1979 | Morin | |
| 4,294,422 A | | 10/1981 | Oderkirk | |
| 4,313,693 A | | 2/1982 | Follows et al. | |
| 4,581,857 A | | 4/1986 | Harbom | |
| D285,648 S | | 9/1986 | Parker et al. | |
| 4,757,649 A | | 7/1988 | Vahldieck | |
| 5,004,191 A | | 4/1991 | Corry | |
| 5,098,045 A | | 3/1992 | Pepper | |
| 5,388,377 A | | 2/1995 | Faulkner | |
| 5,575,118 A | | 11/1996 | Vahldieck | |
| 5,845,435 A | | 12/1998 | Knudson | |
| 5,878,533 A | | 3/1999 | Swanfeld, Jr. | |
| 6,209,826 B1 | | 4/2001 | Pratt | |
| 6,254,039 B1 | | 7/2001 | Zimmerman | |
| 6,543,729 B1 | * | 4/2003 | Ylonen | 248/48.1 |

FOREIGN PATENT DOCUMENTS

| | | | |
|---|---|---|---|
| JP | 10-227106 | * | 8/1998 |

* cited by examiner

*Primary Examiner*—Winnie Yip
(74) *Attorney, Agent, or Firm*—Robert A. Seemann

(57) ABSTRACT

A one-piece molded body includes a horizontal arm that extends into a concave longitudinal recess at the front of the roof of a leaf repellant rain gutter, a vertical arm that contacts the back wall of the gutter and contacts the bottom wall of the trough of the gutter, and by referencing on the contacts, orients a fastener in a fastener support guide portion of the body so that the axis of the fastener extends through the slot opening formed by the longitudinal front of the roof and the longitudinal top of the front of the trough.

16 Claims, 6 Drawing Sheets

LEAF REPELLANT GUTTER BRACKET

This application claims the benefit of U.S. Provisional Application No. 60/316,816, filed Aug. 31, 2001.

BACKGROUND OF THE INVENTION

1. Field of the Invention

The invention pertains to supports for eaves troughs. More particularly to a one-piece molded bracket that supports a leaf shedding gutter and attaches the gutter to a wall.

The bracket references from the floor of the trough and holds a screw or nail fastener aligned with the front opening of the gutter for driving with a screw driver or impact tool accessing the fastener through the front opening of the gutter.

2. Description of the Prior Art

The prior art is replete with patented designs for gutter support system brackets.

U.S. Pat. No. 4,169,570 patented Oct. 2, 1979 by F. Morin, describes an eaves trough bracket. A horizontal plate that is narrow and upturned at the front into a backward facing edge for engaging a lip on the front of the trough, is angled upward at the back in the form of a wider plate. A downward angled tube extends backward from the plate and terminates in a vertical cover plate. A nail extending through the downward angled tube and vertical cover plate is driven into the building.

U.S. Pat. No. 4,294,422 patented Oct. 13, 1981 by W. Odekirk, describes a horizontal strip that is upturned at the front into a backward facing edge for engaging a lip on the front of the trough, extends backward in an upstanding M shape and in an open-downward upstanding U hook spaced from the M. The vertical back wall of the trough extends upward into the hook. A nail extends through holes in the legs of the M so that the downward apex of the M is supported by the side of the nail, the nail continues through both legs of the U and back wall of the trough between them, and into the wall of the building.

U.S. Pat. No. 4,757,649 patented Jul. 19, 1988 by W. Vahldieck, describes a rigid tubular spacer that extends horizontally forward from the vertical back wall of a leaf repellant gutter, over the upwardly open trough of the gutter, into the most forward portion of the concave longitudinal recess of the front of the leaf rejecting roof of the gutter. A nail passes through the front of the roof, through the tube, through the back wall of the gutter and into the wall of the building.

U.S. Pat. No. 5,004,191 patented Apr. 2, 1991 by D. Corry, describes a straight strip that is upturned at the front into a backward facing edge for engaging a lip on the front of the trough. The back end of the strip angles upward and terminates in a C having a short lower leg so that when the upper leg of the C receives the top of the vertical back wall of the trough and the lower leg abuts against the back wall of the trough, and a screw extends through the angled back end at the center of the C, through the back wall of the trough contained in the C, and into the wall of the building, and is tightened, the back end holds the strip horizontal.

U.S. Pat. No. 5,388,377 patented Feb. 14, 1995 by C. Faulkner, describes a straight strip that is upturned at the front into a backward facing edge for engaging a lip on the front of the trough. The back end of the strip is bent back into a right triangle having a hole through the hypotenuse and another hole through the vertical back of the triangle so that when a screw extends through the hypotenuse, vertical back, into the vertical wall of the building and is tightened, the triangle holds the strip horizontal to the wall of the building.

U.S. Pat. No. 5,575,118 patented Nov. 19, 1996 by W. Vahldieck, describes a C-shaped sheet metal strip in which one end of the C fits concentrically into the concave longitudinal recess formed by the downward and backward turned edge of the front of the leaf rejecting roof of the gutter, and the other end of the C fits concentrically into the concave longitudinal recess formed by the downward and backward turned edge of the vertical front wall of the trough of the leaf rejecting gutter. A second strip extends vertically upward from the back wall of the C to the upper underside of the roof of the gutter. A third strip extends downward and backward to the back wall of the trough of the gutter where it is fastened to the back wall of the trough by a first fastener that passes through the back wall to the wall of the building. A second fastener through a fold in the back wall of the gutter attaches the back of the g;utter and back of its roof to the building wall.

U.S. Pat. No. 5,878,533 patented Mar. 9, 1999 by E. Swanfeld Jr., describes an inverted L-shaped strip, the vertical wall of which rests on the floor of the trough of the gutter of the leaf rejecting trough and is fastened to the wall of the building by a screw through the vertical wall into the building. The horizontal wall of the L has a bisecting vertical plate that contacts the underside of the leaf rejecting roof where it supports a transverse heating element, and continues along a line that extends around the recess formed by the downward and backward turned edge of the front of the leaf rejecting roof of the gutter.

U.S. Pat. No. 6,209,826 B1 patented Apr. 3, 2001 by J. Pratt, Jr. describes a horizontal strip that is upturned at the front into a backward facing edge for engaging a lip on the front of the trough. The back of the strip is bent into an open-downward upstanding U hook for receiving the vertical back wall of the trough upward into the hook. A pair of upstanding tabs stamped from the strip are spaced in series from the upstanding U hook and are notched at their tops for receiving a nail. The notches position the nail angled downward toward the front leg of the U so that when the nail is struck, the nail continues through both legs of the U and the back wall of the trough between them, and into the wall of the building. As the nail is struck, the head of the nail bends one tab down and catches the other tab as a washer against the forward leg of the U.

SUMMARY OF THE INVENTION

It is one object of the invention to provide a leaf repellant gutter bracket that supports a fastener for mounting the bracket in a leaf repellant gutter so that the axis of the fastener extends through the longitudinal slot between the leaf repellant roof of the gutter and the trough of the gutter.

It is another object of the invention that the bracket contacts the bottom wall, the back wall and the front and upper portion of the roof of the gutter so that the bracket is held vertical, against rotation in the gutter, for access to a fastener in the bracket, along an axis that extends through the opening between the roof of the gutter and the front wall of the trough of the gutter, and that the bracket holds and guides the fastener having a length, along the axis that extends through the opening.

It is another object of the invention that the bracket contacts the bottom wall, the back wall and the front of the roof of the gutter for reference for guiding the axis of the fastener through the longitudinal slot between the leaf repellant roof of the gutter and the trough of the gutter.

Other objects and advantages of the invention will become apparent to persons skilled in the art from the ensuing description.

For a rain gutter having a roof, a back wall and a trough, wherein the roof extends sloping forward from the back wall of the gutter over the trough of the gutter to the front of the trough spaced above the trough so that the front of the roof forms a longitudinal slot horizontal opening into the gutter along the length of the gutter between the front of the roof and the front of the trough, the front of the roof turning downward and backward forming a concave longitudinal recess, a one-piece bracket includes:

a horizontal bar having a back, and a front extending into the concave side of the recess in contact with the concave side of the recess, a vertical bar connected to the back of the horizontal bar, contacting the back wall of the gutter and extending to the bottom of the trough, guide means for a fastener, extending forward of the back wall of the bracket, configured for holding and guiding a fastener having a longitudinal axis so that the longitudinal axis of the fastener extends normal to the back wall of the gutter and through the slot when the vertical bar contacts the bottom of the trough.

A rain gutter support system includes:

a rain gutter comprising a roof, a back wall and an upwardly open trough having a bottom, wherein the roof of the gutter extends forward from the back wall of the gutter over the trough's upward opening, spaced above the trough so that the front of the roof forms a longitudinal slot horizontal opening into the gutter along a length of the gutter, between the front of the roof and the front of the trough, the front of the roof turning downward and backward forming a concave longitudinal recess, and a bracket comprising:

a horizontal bar having a back, and a front extending along a first axis into the concave side of the recess, in contact at a first location along the length of the gutter with a first downward facing portion of the roof and in contact with a first upward facing portion of the recess for supporting the concave shape of the recess, and in contact at a second location along the length of the gutter spaced from the first location by a width of said horizontal bar, with a second downward facing portion of the roof and in contact with a second upward facing portion of the recess, and in continuous contact with a third downward facing portion of the roof from the first location to the second location for supporting the horizontal bar against twisting around said first axis, a vertical bar connected to the back of the horizontal bar, contacting the back wall of the gutter and extending to the bottom of the trough, a boss extending forward from the vertical bar below and spaced from the horizontal bar, and an opening through the boss extending along the second axis through the vertical bar for supporting and guiding a fastener having a length, along a second axis that extends normal to the back wall of the gutter and through the slot when the fastener is received in the means for supporting, when the vertical bar contacts the bottom of the trough.

BRIEF DESCRIPTION OF THE DRAWINGS

In order that the invention will be more fully comprehended, it will now be described, by way of example, with reference to the accompanying drawings, in which.

DESCRIPTION OF THE PREFERRED EMBODIMENTS

Figure 1:
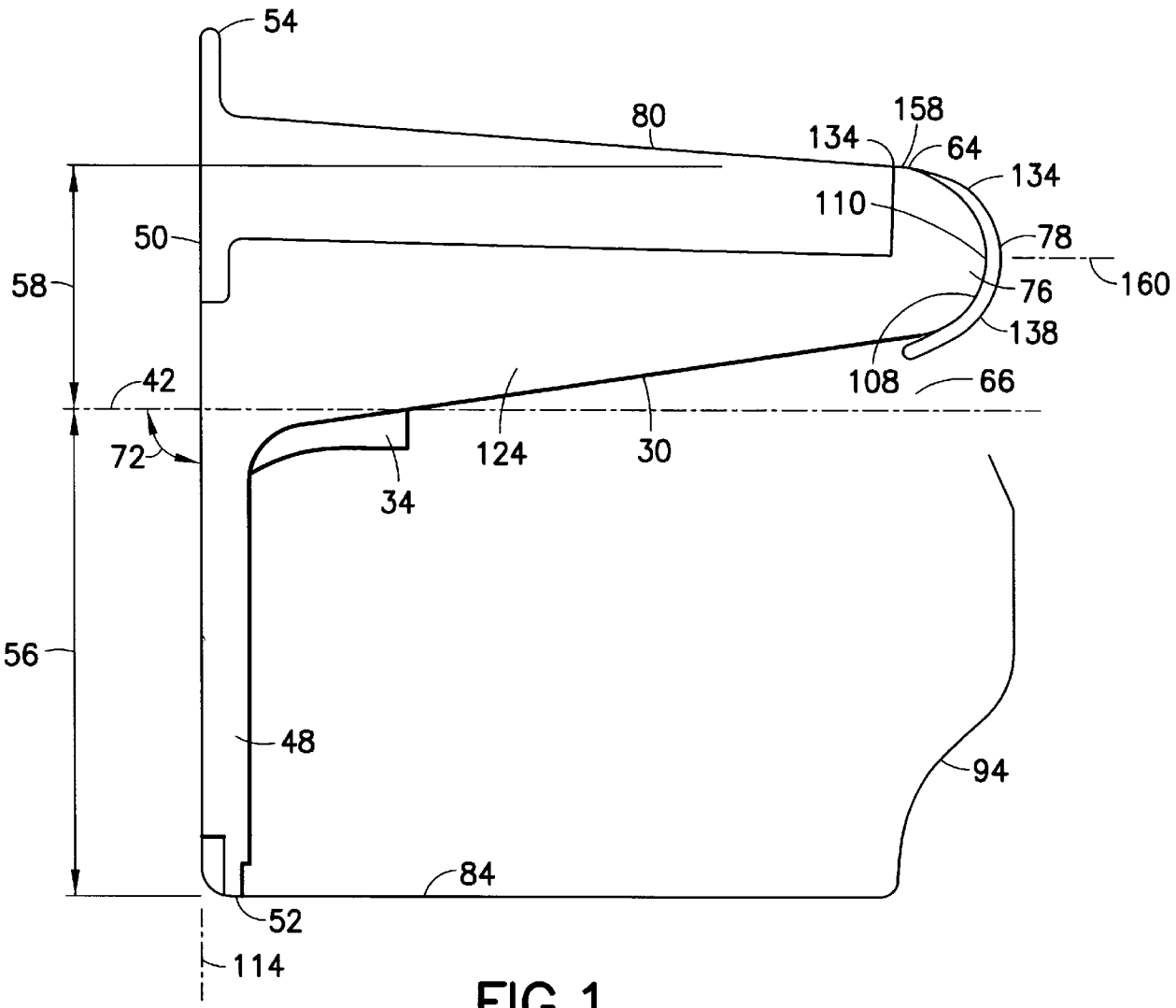
FIG. 1 is a schematic end view of a one piece gutter containing a bracket of the invention. The bracket is in left side view.
Figure 2:
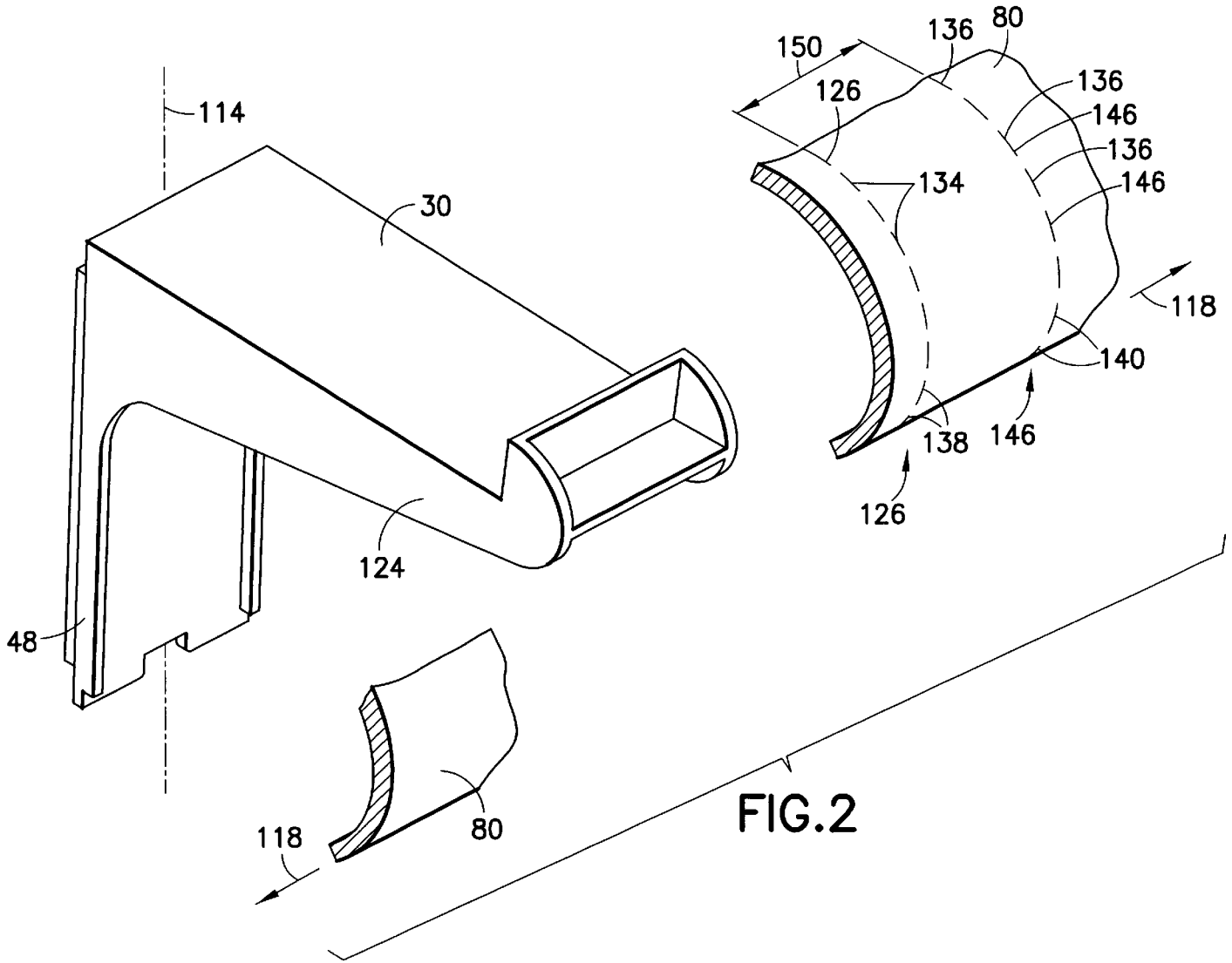
FIG. 2 is a left side perspective view of the bracket of FIG. 1 and a portion of the roof of the gutter in exploded view.
Figure 6:
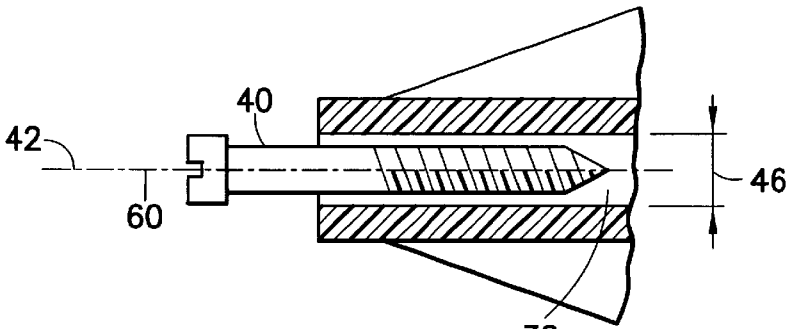
FIG. 6 is a schematic view of a fastener in a boss shown in cross section, of the bracket for fastening the gutter and bracket of FIG. 1 to a wall.
Figure 7:
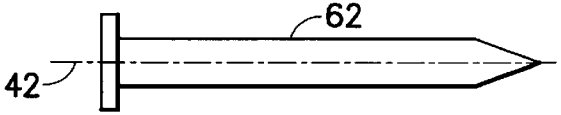
FIG. 7 is a side view of another fastener for fastening the gutter and bracket of FIG. 1 to a wall by way of the boss of FIG. 6.
Figure 3:
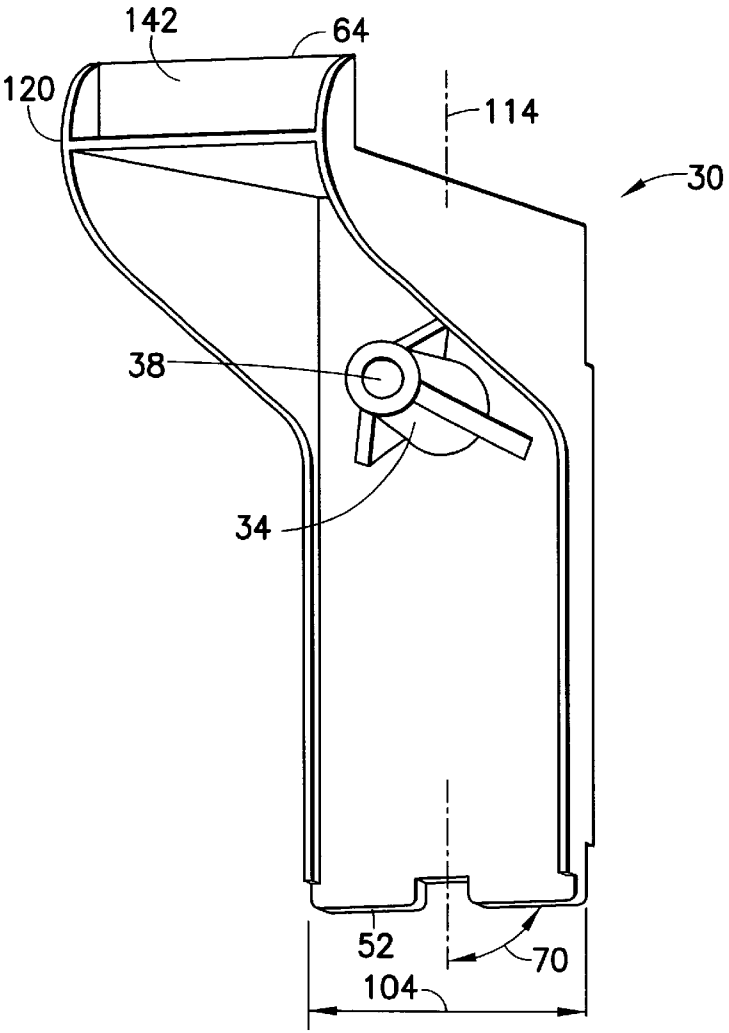
FIG. 3 is a front, lower right side perspective view of the bracket of FIG. 1.
Figure 4:
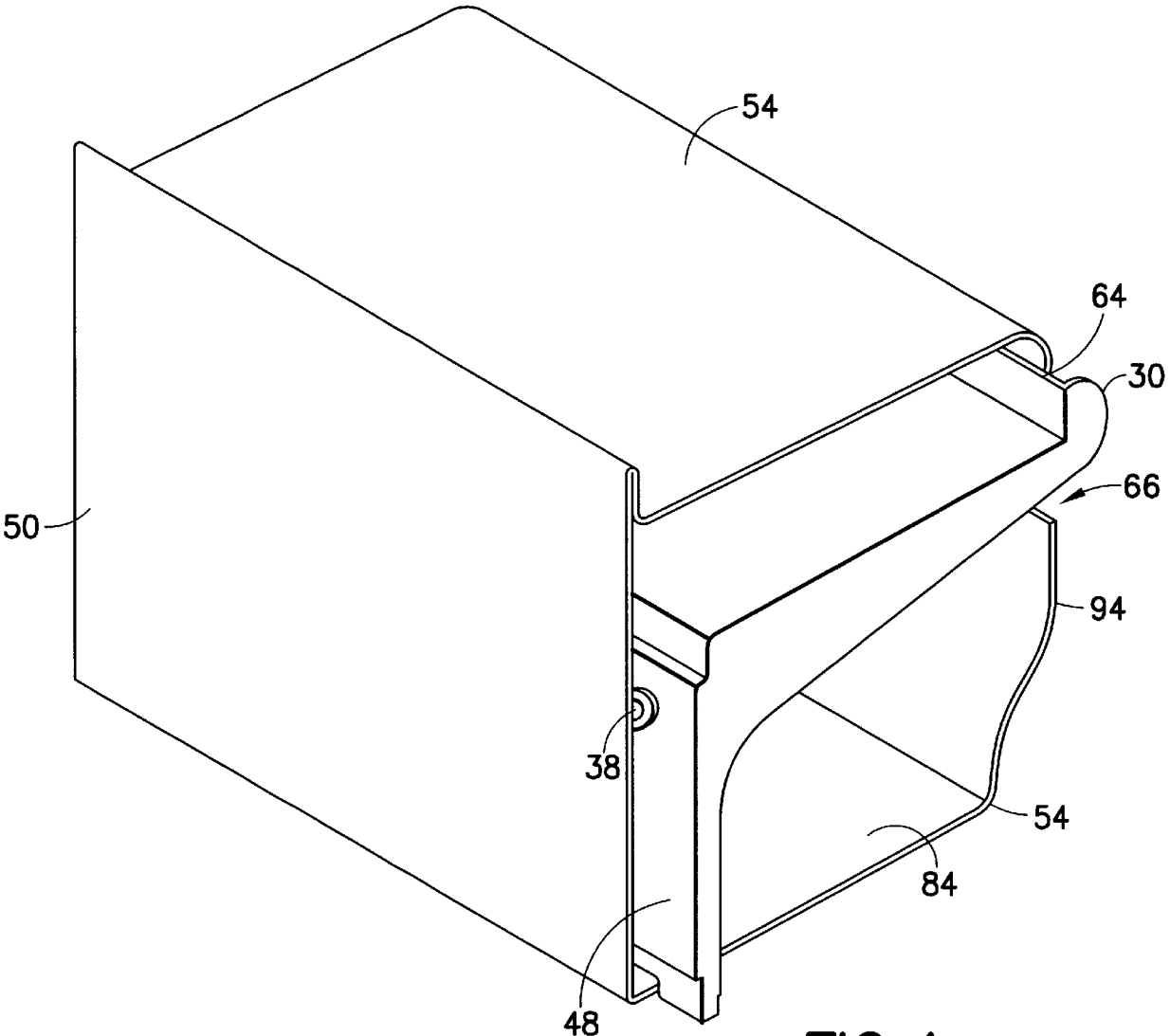
FIG. 4 is an end perspective view of the one piece gutter and bracket arrangement of FIG. 1.
Figure 5:
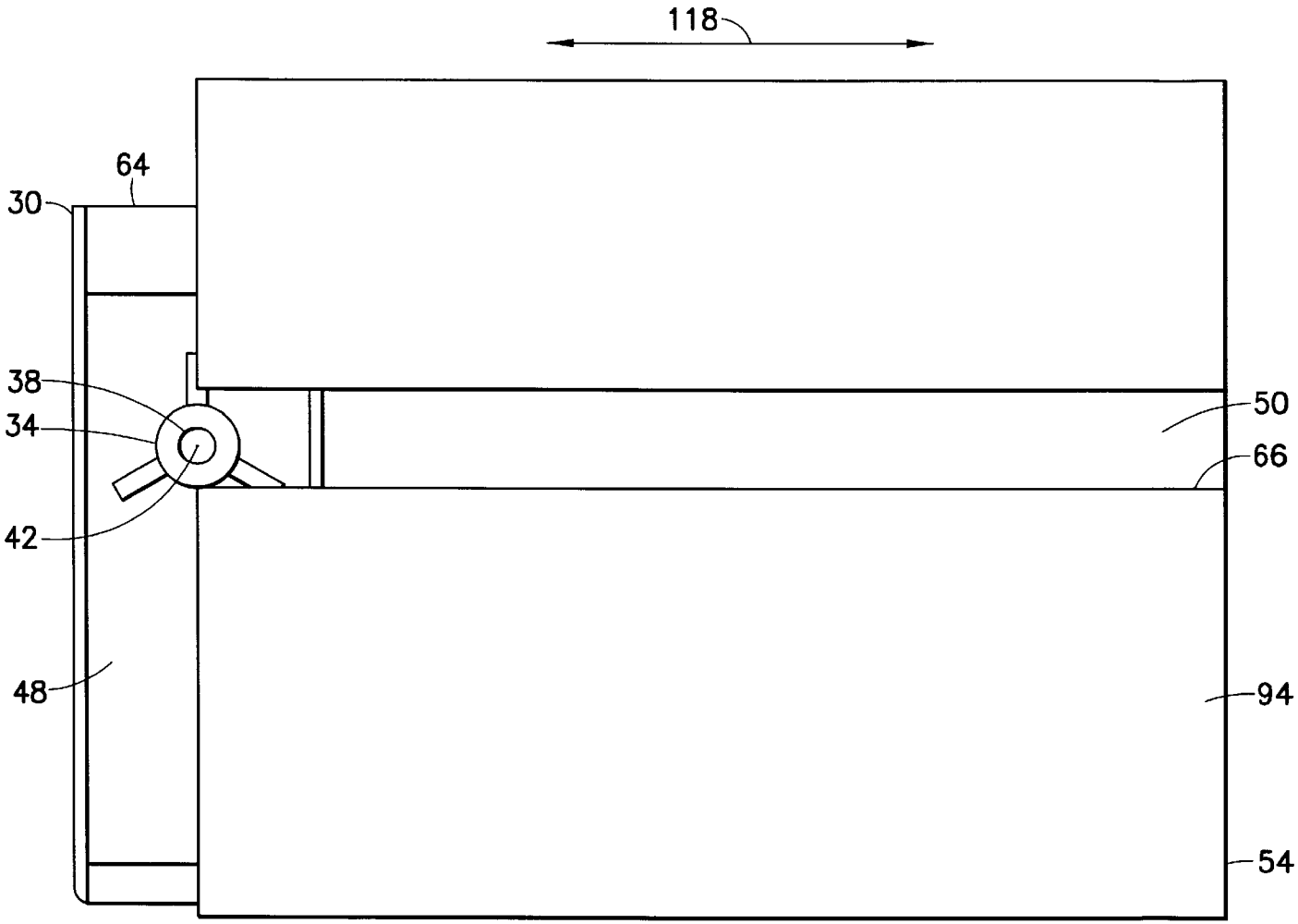
FIG. 5 is a front perspective schematic view of the one piece gutter and bracket arrangement of FIG. 1.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Referring to FIGS. 1–7 bracket 30 is plastic, molded in one piece. Boss 34 of the bracket includes tubular hole 38 that extends longitudinally along axis 42 of the boss.

Hole 38 is for a fastener 40 that passes through back wall 50 of gutter 54 to fasten the bracket to wall 50 and to a wall of a building. The diameter 46 and tubular length of hole 38 is such that the hole positions and holds the axis 60 of the fastener preferably normal to wall 50 of gutter 54, adjacent to and parallel with axis 42, preferably coinciding with axis 42. Preferably axis 42 is normal 72 to vertical axis 114 of back wall 48 and to back wall 50.

Hole 38 is spaced 56 from bottom end 52 of back wall 48 of bracket 30 and spaced 58 from top 64 of the bracket so that when the bracket is inside the gutter with the head 76 of the bracket in contact with the front 78 of roof 80 of the gutter, and bottom 52 of the bracket is in contact with floor 84 of the gutter's trough 94, axis 42 of hole 38 extends through longitudinal slot opening 66 in the gutter. This provides line of sight access along axis 42 by a screw driver, nail punch, or other fastener driving tool to the end of the fastener by way of slot opening 66.

Fastener 40 is a screw. Fastener 62 is a nail that will also be held by hole 38 for access to the head by line of sight through slot opening 66.

Bottom end 52 is preferably normal 70 to the vertical axis 114 of back wall 48 and is large enough in width 104 so that the bracket supports itself with the vertical axis normal to length 118 of the rain gutter when head 76 is in concave longitudinal recess 108 of roof 80 and bottom end 52 is resting on floor 84 of the trough.

Front 120 of horizontal bar 124 extends into the concave side 110 of concave longitudinal recess 108, in contact at location 126 along the length 118 of the gutter with the downward facing portion 134 of roof 80 and in contact with upward facing portion 138 of the recess for supporting the concave shape of the recess, and in contact at location 146 along the length of the gutter spaced 150 from the first location by a width of the horizontal bar, with downward facing portion 136 of the roof and in contact with upward facing portion 140 of the recess, and in continuous contact by wall 142 with downward facing portion 158 of the roof from location 126 to location 146 for supporting the horizontal bar against twisting around axis 160.

Figure 8:
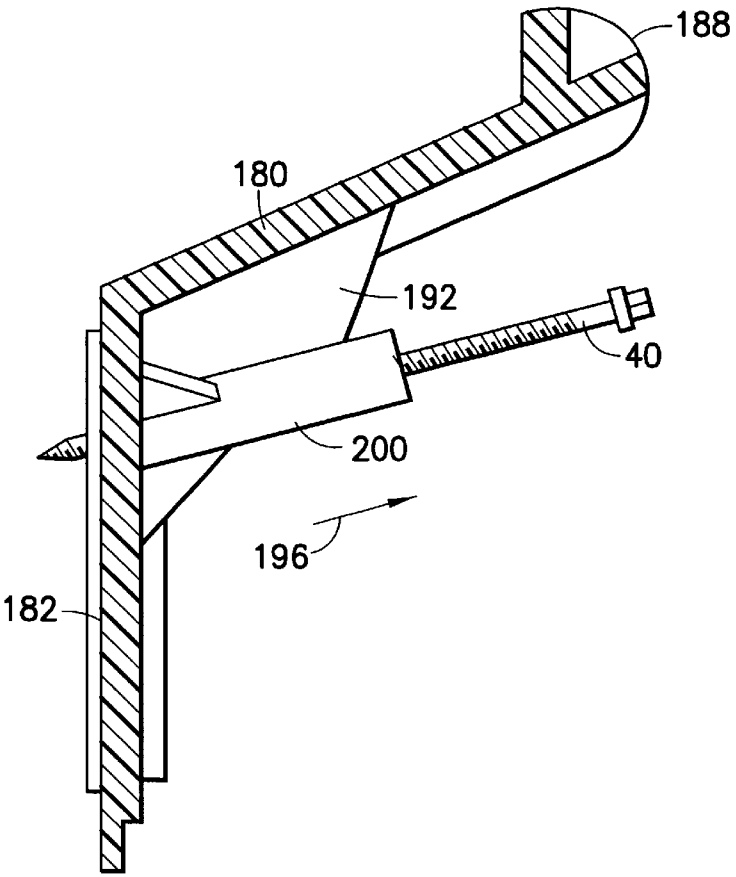
FIG. 8 is a side view in cross section of another bracket of the invention.

In FIG. 8, horizontal bar 180 connected to vertical bar or back wall 182 of bracket 188 is shown in cross section. Ridge 192 extends vertically from forward extending 196 boss 200 to bar 180.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

What is claimed is:

1. A rain gutter support system comprising:

a rain gutter comprising:

a roof, a back wall and an upwardly open trough having a bottom, wherein the roof of the gutter extends forward from the back wall of the gutter over the upwardly open trough, spaced above the trough so that the front of the roof forms a longitudinal slot horizontal opening into the gutter along a length of the gutter, between the front of the roof and the front of the trough, the front of the roof turning downward and backward forming a concave longitudinal recess, a bracket comprising:

a horizontal bar having a back, and a front having a convex portion turning upward and backward and extending longitudinally along a width of the horizontal bar, said convex portion extending into the concave side of the recess in contact with the concave side of the recess, a vertical bar connected to the back of the horizontal bar, contacting the back wall of the gutter and extending to the bottom of the trough, longitudinal guide means for holding and guiding a fastener, said longitudinal guide means having a tubular member, extending from the vertical bar in a forward direction, configured along a first axis that extends normal to the back wall of the gutter and through the slot when the vertical bar contacts the bottom of the trough, so that said longitudinal guide means for holding and guiding restricts a fastener having a length to movement of the fastener along said first axis when the fastener is inserted into one end of said longitudinal guide means for holding and guiding.

2. A rain gutter support system comprising:

a rain gutter comprising:

a roof, a back wall and an upwardly open trough having a bottom, wherein the roof of the gutter extends forward from the back wall of the gutter over the upwardly open trough, spaced above the trough so that the front of the roof forms a longitudinal slot horizontal opening into the gutter along a length of the gutter, between the front of the roof and the front of the trough, the front of the roof turning downward and backward forming a concave longitudinal recess, a bracket comprising:

a horizontal bar having a back, and a front having convex portion turning upward and backward and extending longitudinally along a width of the horizontal bar, said convex portion extending into the concave side of the recess, in contact with a downward facing portion of the roof and in contact with an upward facing portion of the recess for supporting the concave shape of the recess, a vertical bar connected to the back of the horizontal bar, contacting the back wall of the gutter and extending to the bottom of the trough, means for supporting and guiding a fastener having a length when the fastener is received in said means for supporting along a first axis that extends horizontally from the back wall of the gutter and through the slot and guiding when the vertical bar contacts the bottom of the trough, said means for supporting and guiding comprising a tube having a front opening, extending from the vertical bar in a forward direction a sufficient length so that the tube restricts the fastener to movement along the first axis to the vertical bar when the fastener is inserted into the front opening.

3. The rain gutter support system of claim 2 wherein said tube is open through said vertical bar.

4. The rain gutter support system of claim 2 further comprising:

a ridge extending from said tube laterally from said first axis, to said horizontal bar, and to said vertical bar.

5. A rain gutter support system comprising:

a rain gutter comprising:

a roof, a back wall and an upwardly open trough having a bottom, wherein the roof of the gutter extends forward from the back wall of the gutter over the upwardly open trough, spaced above the trough so that the front of the roof forms a longitudinal slot horizontal opening into the gutter along a length of the gutter, between the front of the roof and the front of the trough, the front of the roof turning downward and backward forming a concave longitudinal recess, a bracket comprising:

horizontal bar having a back, and a front extending along a first axis into the concave side of the recess, said front having a first convert portion in contact at a first location along the length of the gutter with a first downward facing portion of the roof and in contact with a first upward facing portion of the recess for supporting the concave shape of the recess, and a second convex portion in contact at a second location along the length of the gutter spaced from the first location by a width of said horizontal bar, with a second downward facing portion of the roof and in contact with a second upward facing portion of the recess for supporting the horizontal bar against twisting around said first axis, a vertical bar connected to the back of the horizontal bar, contacting the back wall of the gutter and extending to the bottom of the trough, means for supporting and guiding a fastener having a length when the fastener is received in said means for supporting and guiding, along a second axis that extends from the vertical bar and through the slot when the vertical bar contacts the bottom of the trough, said means for supporting and guiding comprising a tube having a front opening, extending sufficiently from the vertical bar in a forward direction so that the tube restricts the fastener to movement along the second axis to the vertical bar when the fastener is inserted into the front opening.

6. The rain gutter support system of claim 5 wherein said tube is open through said vertical bar.

7. The rain gutter support system of claim 5 further comprising:

a ridge extending from said tube laterally from said second axis, to said horizontal bar, and to said vertical bar.

8. A rain gutter support system comprising:

a rain gutter comprising:

a roof, a back wall and an upwardly open trough having a bottom, wherein the roof of the gutter extends forward from the back wall of the gutter over the upwardly open trough, spaced above the trough so that the front of the roof forms a longitudinal slot horizontal opening into the gutter along a length of the gutter, between the front of the roof and the front of the trough, the front of the roof turning downward and backward forming a concave longitudinal recess, a bracket comprising:

a horizontal bar having a back, and a front extending along a first axis into the concave side of the recess, in contact at a first location along the length of the gutter with a first downward facing portion of the roof and said front having a first convex portion in contact with a first upward facing portion of the recess for supporting the concave shape of the recess, and a second convex portion in contact at a second location along the length of the gutter spaced from the first location by a width of said horizontal bar, with a second downward facing portion of the roof and in contact with a second upward facing portion of the recess, and in continuous contact with a third downward facing portion of the roof from the first location to the second location for supporting the horizontal bar against twisting around said first axis, a vertical bar connected to the back of the horizontal bar, contacting the back wall of the gutter and extending to the bottom of the trough, tubular means for supporting and guiding a fastener having a length when the fastener is received in said means for supporting and guiding, extending from the vertical bar in a forward direction along a second axis that extends from the back wall of the gutter and through the slot when the vertical bar contacts the bottom of the trough, configured along the second axis so that said tubular means restricts the fastener to movement along the second axis when the fastener is inserted into one end of said tubular means.

9. A rain gutter support system comprising:

a rain gutter comprising:

a roof, a back wall and an upwardly open trough having a bottom, wherein the roof of the gutter extends forward from the back wall of the gutter over the upwardly open trough, spaced above the trough so that the front of the roof forms a longitudinal slot horizontal opening into the gutter along a length of the gutter, between the front of the roof and the front of the trough, the front of the roof turning downward and backward forming a concave longitudinal recess, a bracket comprising:

a horizontal bar having a back, and a front extending along a first axis into the concave side of the recess, said front having a first convex portion in contact at a first location along the length of the gutter with a first downward facing portion of the roof and in contact with a first upward facing portion of the recess for supporting the concave shape of the recess, and a second convex portion in contact at a second location along the length of the gutter spaced from the first location by a width of said horizontal bar, with a second downward facing portion of the roof and in contact with a second upward facing portion of the recess for supporting the horizontal bar against twisting around said first axis, and a horizontal portion spaced from the roof in contact at a third location along the length of the gutter between the first and second location, a vertical bar connected to the back of the horizontal bar, contacting the back wall of the gutter and extending to the bottom of the trough, means for supporting and guiding a fastener having a length when the fastener is received in said means for supporting and guiding, along a second axis that extends from the vertical bar and through the slot when the vertical bar contacts the bottom of the trough, said means for supporting and guiding comprising a tube having a front opening, extending sufficiently from the vertical bar in a forward direction so that the tube restricts the fastener to movement along the second axis to the vertical bar when the fastener is inserted into the front opening.

10. The rain gutter support system of claim 9 wherein said tube is open through said vertical bar.

11. The rain gutter support system of claim 9 further comprising:

a ridge extending from said tube laterally from said second axis, to said horizontal bar and to said vertical bar.

12. The rain gutter support system of claim 9 wherein said horizontal bar is in continuous contact with a third downward facing portion of the roof from the first location to the second location.

13. A rain gutter support system comprising:

a rain gutter comprising:

a roof, and an upwardly open trough having a bottom and a vertical back wall, wherein the roof of the gutter extends forward from above the back wall of the trough and over the upwardly open trough, spaced above the trough so that the front of the roof forms a longitudinal slot horizontal opening into the gutter along a length of the gutter, between the front of the roof and the front of the trough, the front of the roof turning downward and backward forming a concave longitudinal recess, a unitary molded element comprising:

a horizontal bar having a back, and a front extending along a first axis into the concave side of the recess, said front having a first convex portion in contact at a first location along the length of the gutter, with a first downward facing portion of the roof and in contact with a first upward facing portion of the recess for supporting the concave shape of the recess, and a second convex portion in contact at a second location along the length of the gutter spaced from the first location by a width of said horizontal bar, with a second downward facing portion of the roof and in contact with a second upward facing portion of the recess, for supporting the horizontal bar against twisting around said first axis, a vertical bar connected to the back of the horizontal bar, contacting the back wall of the trough and extending to the bottom of the trough, a boss extending forward from said vertical bar below and spaced from said horizontal bar, a tubular opening through said boss extending forward along a second horizontal axis that extends from said vertical bar and through said slot when the vertical bar contacts the bottom of the trough, said tubular opening extending sufficiently along said second horizontal axis so that said tubular opening supports and restricts a fastener having a length, to movement along the second horizontal axis when the fastener is inserted in a front end of said tubular opening.

14. The rain gutter support system of claim 13 wherein said horizontal bar is in continuous contact with a downward facing portion of the roof from the first location to the second location.

15. The rain gutter support system of claim 14 further comprising:

a ridge extending from said boss, to said horizontal bar and said vertical bar.

16. A one piece bracket for a rain gutter having a roof, a back wall and a trough, wherein the roof extends sloping forward from the back wall of the gutter over the trough of the gutter to the front of the trough spaced above the trough so that the front of the roof forms a longitudinal slot horizontal opening into the gutter along the length of the gutter between the front of the roof and the front of the trough, the front of the roof turning downward and backward forming a concave longitudinal recess, the bracket comprising:

a horizontal bar having a back, and a front having a convex portion turning upward and backward and extending longitudinally along a width of the horizontal bar, a vertical bar connected to the back of the horizontal bar, configured so that when the vertical bar contacts the back wall of the gutter and the bottom of the trough, the longitudinal convex portion of the front of the horizontal bar extends into the concave side of the recess in contact with the concave side of the recess, means for guiding a fastener, said means for guiding having a tubular member extending a length from the vertical bar in a forward direction, configured so that said means for guiding holds and restricts a fastener having a length, to movement along a first axis that extends from the vertical bar through the slot when the vertical bar contacts the bottom of the trough and the back wall of the gutter, when the fastener is inserted into one end of said means for guiding.

* * * * *

UNITED STATES PATENT AND TRADEMARK OFFICE

CERTIFICATE OF CORRECTION

PATENT NO. : 6,745,517 B2
DATED : June 8, 2004
INVENTOR(S) : Wayne Vahldieck

It is certified that error appears in the above-identified patent and that said Letters Patent is hereby corrected as shown below:

Column 6,
Line 14, after "for supporting", insert -- and guiding --,
Line 16, delete "and guiding" after "the slot".
Line 42, insert -- a -- before "horizontal bar having a back",
Line 44, delete "convert" and replace therewith -- convex --.

Column 7,
Line 24, before "in contact at a first location", insert -- said front having a first convex portion --,
Line 26, delete "said front having a first convex portion" before "in contact with a first upward facing portion".

Signed and Sealed this

Twenty-seventh Day of July, 2004

JON W. DUDAS
*Acting Director of the United States Patent and Trademark Office*